US005810146A

United States Patent [19]

Harbaugh

[11] Patent Number: 5,810,146

[45] Date of Patent: Sep. 22, 1998

[54] WIDE EDGE LEAD CURRENCY THREAD DETECTION SYSTEM

[75] Inventor: Steven K. Harbaugh, Castro Valley, Calif.

[73] Assignee: Authentication Technologies, Inc., Dublin, Calif.

[21] Appl. No.: 741,521

[22] Filed: Oct. 31, 1996

[51] Int. Cl.[6] ..... G07D 7/00

[52] U.S. Cl. ..... 194/206; 324/663

[58] Field of Search ..... 194/206, 207; 324/663, 672

[56] References Cited

U.S. PATENT DOCUMENTS

| | | | |
|---|---|---|---|
| 4,255,652 | 3/1981 | Weber | 209/534 X |
| 4,355,300 | 10/1982 | Weber | 235/451 |
| 5,122,754 | 6/1992 | Gotaas | 324/676 |
| 5,308,992 | 5/1994 | Crane et al. | 250/556 |
| 5,394,969 | 3/1995 | Harbaugh | 194/206 |
| 5,417,316 | 5/1995 | Harbaugh | 194/206 |
| 5,419,424 | 5/1995 | Harbaugh | 194/206 |
| 5,535,871 | 7/1996 | Harbaugh | 194/206 |

FOREIGN PATENT DOCUMENTS

| | | |
|---|---|---|
| 0133656 | 3/1985 | European Pat. Off. . |
| 0158079 | 10/1985 | European Pat. Off. . |
| 0698866 | 2/1996 | European Pat. Off. . |
| 3236374 | 4/1984 | Germany . |
| 2211976 | 7/1989 | United Kingdom . |

OTHER PUBLICATIONS

IBM Technical Disclosure Bulletin, vol. 28, No. 1, Jun. 1985, "Capacitive Item Sensor for Supermarket Scanner", pp. 376–377.

*Primary Examiner*—F. J. Bartuska

*Attorney, Agent, or Firm*—Richard H. Kosakowski, Esq.; Holland & Bonzagni, P.C.

[57] ABSTRACT

A document verification device detects the presence of a metal security thread embedded in a document such as currency paper. The device includes a sensor pad arrangement and corresponding signal processing electronics. The arrangement includes a single central sensing pad flanked by an array of twenty-seven pairs of outer pads. Each pair of outer pads in the array is electrically connected together. Every pad is made of conductive material. The width dimension of each outer pad in the array is greater than the width of the security thread. Each outer pad in the array is preferably angled to improve the reliability of detection of the security thread. The electronics generates a square wave oscillator signal that is applied to the outer array pads in a pattern that includes two adjacent pairs of array pads having the positive voltage level portion of the square wave signal applied thereto, and the following two adjacent pairs of array pads having the negative voltage level portion of the square wave signal applied thereto. This pattern is sequenced in time over the entire array. The document to be verified is transported with respect to the sensor pad arrangement such that the wide edge of the document is the leading edge. As the thread passes over the array, the pattern is sequenced throughout the pads fast enough such that, at a point in time, the thread will bridge the central sensing pad with a pair of outer two pads first having the positive voltage level portion of the square wave signal applied thereto, and then later the thread will bridge the central sensing pad with the same pair of outer two pads now having the negative voltage level portion of the square wave signal applied thereto. Since the thread is metallic, it will capacitively couple the square wave signal into the central sensing pad. The electronics senses the signal coupled to the sensing pad and interprets a valid security thread as being present in the currency from certain characteristics of the sensed signal.

9 Claims, 8 Drawing Sheets

WIDE EDGE LEAD CURRENCY THREAD DETECTION SYSTEM

BACKGROUND OF THE INVENTION

This invention generally relates to a device for verifying the authenticity of a document, and more particularly to a device for detecting the presence of a security thread embedded in a document such as currency or banknote paper to verify the authenticity of the document.

It is known in the modem art of documents, especially documents of value such as currency and banknote paper, to attempt to insure the authenticity of the document by embedding a security thread either partially or fully within the document paper during document manufacture. Some means or method, either automatic or manual, is then devised for sensing the presence of the thread to authenticate the document. Such authentication is typically carried out at a location (e.g., bank, vending machine) where the document is received or handled.

The use of security threads as a means of document authentication has increased due to sophisticated modem document reproduction equipment, such as high-resolution scanners and true-color photocopying machines and printers - the tools of modem counterfeiters. If the document has an embedded security thread, it is difficult, if not impossible, to accurately counterfeit the document using such equipment. This is because the uniquely identifiable and detectable physical characteristics of the thread are difficult to reproduce.

A known thread comprises a plastic substrate having selected metallized (e.g., aluminum) characters or other indicia formed on one or both opposing surfaces of the substrate. The thread is typically embedded entirely within the document paper and is not present on either opposing surface of the paper. See U.S. Pat. Nos. 4,652,015 and 4,761,205.

The security thread described therein has printed characters of extreme fine-line clarity and high opacity such that human-readability of the printing is possible by means of relatively intense light transmitted directly at and through the paper. Yet, the printing remains completely indiscernible to the human eye under light reflected off of the paper surface. The highly reflective metallic thread printing is invisible under the reflected light used by modem reproduction equipment. Instead, if the thread printing was legible under reflected light, the public could see the printing by a casual visual inspection. The printing could then be easily counterfeited.

This metallized security thread insures that the public does not come to rely on any easily-simulated thread characteristics. This is accomplished by manufacturing currency and banknote papers with a thread that is virtually invisible under reflected light; i.e., with no manifestation on the surface of the currency or banknote paper that such a thread is in the note. Authentication of the security thread is normally carried out in a two-step test; namely, wherein the thread is legible under transmitted light and invisible under reflected light.

An easy way of checking the authenticity of the thread is to place the currency under an intense light source to visually observe the thread characters. Although visual inspection can generally detect a counterfeit note if given the proper lighting conditions, it is time-consuming and expensive. Further, in commercial situations where such an intense light source is unavailable (thus making a human check for thread presence virtually impossible), it is desirable to provide means for automatically determining the thread's presence. Various means for verifying the presence and authenticity of a thread using optical means alone and in combination with magnetic means are exemplified in U.S. Pat. Nos. 4,980,569 and 5,151,607.

In light of the inherent shortcomings of such optical methods, other verification means have been developed, such as microwave, magnetic and capacitive devices. Capacitive devices generally operate on the principle of detecting a change in the capacitance of a sensor, such change being due to the dielectric properties of a metallized security thread. A metallized thread has dielectric properties that are vastly different from those of the document paper carrying the thread. Various capacitive schemes are known in the prior art. In one, the metallized thread is one plate of a capacitor, and draws electrical charge off a second plate of the capacitor, the second plate acting as a sensing plate of the verification device. In contrast, the paper itself has little or no effect on the amount of charge on the sensing plate. By drawing charge off the sensing plate, the security thread effectively increases a capacitance value sensed by the verification device. This changing capacitance value is a detectable feature.

However, some capacitive verification devices may be fooled by electrically-conductive marks (e.g., pencil lines) placed on the surface of the document paper. This can be especially troublesome for currency verification devices used in unattended sales transactions of goods; for example, in automated vending machines that incorporate paper currency acceptors. Vending machines, such as those that dispense products, those that accept payment for gasoline, or those that make change for paper currency, are becoming more prevalent and are accepting higher denomination currency bills in unattended transactions. This is due to the inflationary prices of goods and the need for convenience. Also, unattended bill acceptors are expanding into areas such as casino gaming and video game machines. The addition of bill acceptors and changers in these machines has resulted in a large increase in the number of unattended transactions. For these machines, it is imperative that the currency acceptor/changer have some means for reliably discriminating between genuine and counterfeit bills. Examples of security thread verification devices that provide for machine readability of a metallized security thread using a capacitance bridge technique are disclosed in U.S. Pat. Nos. 5,308,992 and 5,394,969. Other capacitive-type verification devices are disclosed in U.S. Pat. Nos. 5,417,316, 5,419,424 and 5,535,871.

A security thread may have printed characters and/or other indicia formed on one or both opposing surfaces of the plastic substrate either in the form of positive image characters or negative image characters. For a positive image thread, the metal only occupies areas on the thread defined by the characters. These positive image threads are widely used in United States currency paper. On the other hand, the negative image thread has its characters formed by the removal of metal, thereby exposing the plastic substrate. All of the non-character portions of the thread surface are usually completely coated with metal. These non-metal, or "clear text" or "de-metallized" characters are defined by metal boundaries. Such negative image security threads are widely used in currencies such as the German Deutsche Mark.

In contrast to the above two types of security threads having selected metallized or de-metallized characters, another known type is a "solid" security thread. This thread comprises a plastic substrate having metal deposited entirely on one or both opposing surfaces of the substrate. As used herein, the word "solid" refers to a substrate having one or both of its opposing surfaces completely covered by metal. Such a solid or continuously metallized thread sometimes has printed indicia indicative of currency denomination. However, normally the printing cannot be seen even under an intense light source; therefore, such printing is oftentimes eliminated. It is known to use solid security threads within the currency of, e.g., Saudi Arabia.

Accordingly, it is a primary object of the present invention to provide a device that verifies the authenticity of a document, such as currency or banknote paper, by sensing the presence of a security thread embedded within the paper.

It is a general object of the present invention to provide such a verification device for use in a host device such as a currency counter.

It is another object of the present invention to provide such a verification device that senses documents, such as currency or banknote papers, having a rectangular-shaped solid security thread embedded therein, wherein the security thread is embedded in the paper in a direction parallel to the narrow edge of the paper, the verification device detecting the thread as the paper is transported in the wide-edge-leading direction of the rectangular-shaped paper.

It is yet another object of the present invention to provide for high-speed, automated document verification.

Another object of the present invention is to provide for cost-effective counterfeit deterrence and detection of documents of value.

Still another object of the present invention is to provide a document verification device that can be easily and cost-effectively incorporated into known or future automated processing equipment, such as high-speed central bank sorting machines, table-top currency counters used in banks or businesses, and bill acceptors and changers in vending machines.

It is yet another object of the present invention to provide for accurate, low-cost, high-speed commercial sorting and counting of currency or banknote paper.

The above and other objects and advantages of this invention will become readily apparent when the following description is read in conjunction with the accompanying drawings.

SUMMARY OF THE INVENTION

To overcome the deficiencies of the prior art and to achieve the objects listed above, the Applicant has invented a device for authenticating documents such as currency or banknote paper.

In a preferred embodiment, the verification device of the present invention detects the presence of a solid metallized security thread embedded entirely within a document. The thread is rectangular in shape and embedded in the document with its long dimension parallel to the narrow dimension of the rectangular-shaped document (i.e., perpendicular to the wide dimension of the document).

The device comprises a sensor pad arrangement and corresponding signal processing electronics. The sensor pad arrangement comprises a single central sensing pad flanked by an array of twenty-seven pairs of outer stimuli pads. Each pair of outer pads in the array is electrically connected together. Every pad comprises an electrically-conductive metallic material. The width dimension of each pad in the array is greater than the width of the security thread. Each pad in the array is preferably angled along its width dimension to improve the reliability of detection of the security thread by preventing the security thread from falling between two adjacent pads where it may not be accurately detected.

The signal processing electronics generates a square wave oscillator signal that is applied to the outer array pads in a certain pattern. In a preferred embodiment, the pattern comprises two adjacent pairs of array pads having the positive voltage level portion (i.e., positive phase) of the square wave signal applied thereto, with the following two adjacent pairs of array pads having the negative voltage level portion (i.e., negative phase) of the square wave signal applied thereto. This pattern is sequenced in time along the entire array.

In operation, the document to be verified is transported in a physical relationship with respect to the sensor pad arrangement such that the wide edge of the document is the leading edge. As the thread within an authentic document passes over the array, the pattern is sequenced throughout the pads fast enough such that at some point in time the thread will bridge the central sensing pad with a pair of outer two array pads first having the positive phase of the square wave signal applied thereto, and later the same pair of outer two pads have the negative phase of the square wave signal applied thereto. Since the thread is metallic, it will capacitively couple the square wave signal on the pair of outer array pads into the central sensing pad. The signal processing electronics senses the signal coupled to the central sensing pad and interprets a valid security thread as being present in the currency from certain voltage level (i.e., phase) characteristics of the sensed signal.

The present invention has utility in that by stimulating the outer array pads with the oscillator signals in a particular pattern or sequence, and then analyzing the results, it is possible to not only verify the authenticity of the thread, but to also identify the specific location of a metallized security thread within currency or banknote paper. Further, by altering the voltage level, or phase, of the input signal (e.g., 180 degrees) and by conditioning the signal output on the single central sensing pad, it is possible to distinguish genuine security threads from potential artifacts, such the document paper itself and electrically-conductive counterfeit means associated with the paper.

DETAILED DESCRIPTION OF THE PREFERRED EMBODIMENTS

Figure 1:
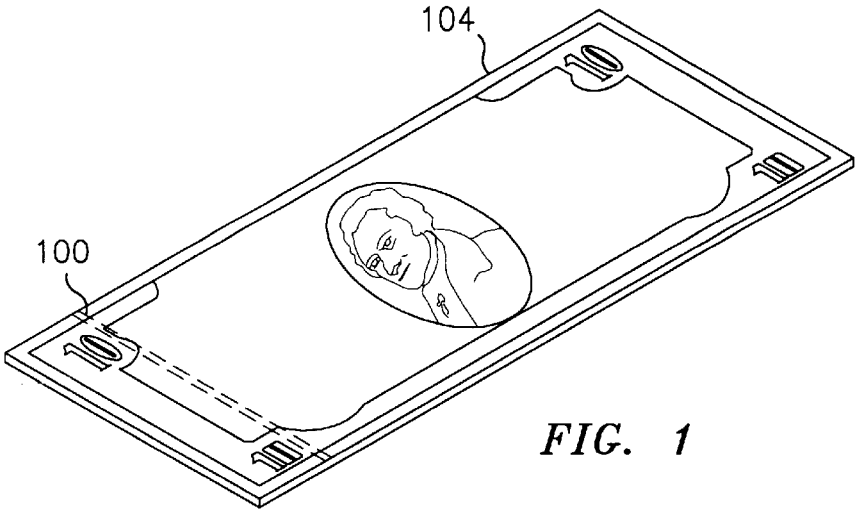
FIG. 1 is a perspective view of a currency or banknote paper having a metallized security thread embedded therein.

Referring to the drawings in detail, a preferred embodiment of a security thread 100 for use with a document 104, especially with documents of value such as currency or banknote papers, is illustrated therein. The thread 100 is preferably a "solid" or continuously metallized thread, as mentioned hereinbefore and as described in detail hereinafter. Also illustrated is a preferred embodiment of a verification device 108, according to the present invention, for determining the authenticity of the document 104 by sensing the presence of the thread 100 embedded in the document. The verification device 108 is intended for use in items such as currency counters, bill sorters and automatic vending machines; each item being generally referred to hereinafter as a "host".

Figure 2:
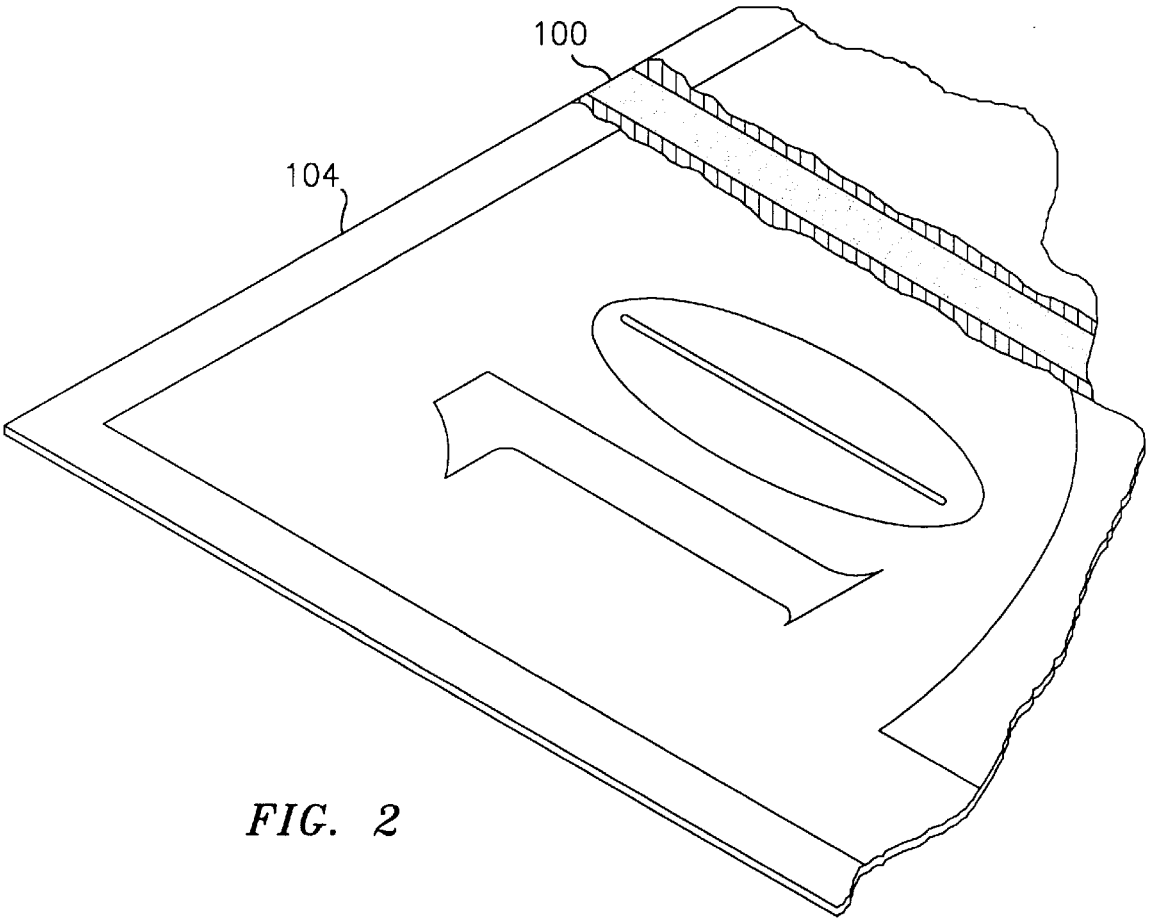
FIG. 2 is a perspective view, partially cutaway, of a portion of the currency paper of FIG. 1, illustrating in greater detail the security thread within the currency paper.

FIGS. 1–2 illustrate an example of currency or banknote paper 104 that includes the security thread 100 (illustrated in phantom in FIG. 1) embedded entirely within the paper, and not disposed on either opposing surface of the paper. In an exemplary embodiment of a currency or banknote paper 104, the thread 100 typically extends from top to bottom and transversely across the linear extent (i.e., left-to-right direction) of the paper. That is, the rectangular-shaped security thread 100 has its long dimension parallel to the narrow dimension of the rectangular-shaped currency paper 104. Conversely, the long dimension of the thread 100 is perpendicular to the long dimension or wide edge of the paper 104. As described in detail hereinafter, in the operation of a preferred embodiment of the verification device 108 of the present invention, the currency paper 104 is transported in a physical relation past a sensor pad arrangement 112 of the verification device 108 with the wide edge of the paper 104 as the leading edge; that is, the long dimension of the thread 100 is parallel to the direction of travel of the paper.

The security thread 100 comprises a substrate of an insulative material, preferably plastic or mylar. However, the substrate may comprise any clear or translucent non-conductive material. Such materials may include polyester, regenerated cellulose, polyvinylchloride and other plastic film. The substrate may have a width ranging from approximately 0.5 millimeters (mm) to about 3.0 mm. In a preferred embodiment, one or both opposing surfaces of the substrate are completely and continuously coated with metal, such as aluminum. The metal may be deposited onto the substrate surface using a variety of techniques, such as vacuum deposition or sputtering. If desired, characters may be formed in or on the solid metal material.

However, instead of a "solid" thread 100, the thread substrate may have selective metallized or de-metallized characters (e.g., alphanumeric) formed on one or both of its opposing surfaces. These characters may be formed on the substrate using a variety of techniques, such as vacuum deposition, sputtering, selective metallization by electrodeposition, directly hot-stamping onto the thread surface, or using a mask or template in a vacuum metallizer, and other methods involving metallization and selective de-metallization by chemical etching, laser etching and the like. For example, after the aluminum is vacuum deposited onto the substrate surface, the characters may be formed using a resist and etch technique. The aluminum deposited on the thread has a typical thickness in a range of 100–400 angstroms.

A security thread 100 having selected metallized or de-metallized characters may be utilized with the verification device 108 of the present invention as long as sufficient quantities of metal are present or associated with the thread 100 to be detected by the device 108. The method of metal detection of the verification device 108 of the present invention is described hereinafter in greater detail. From the teachings herein, it should be apparent to one of ordinary skill in the art as to a sufficient amount of metal coating for the thread 100 needed for proper operation of the verification device 108 of the present invention. It should be understood that the security thread 100 and the document 104 in which it is embedded both form no part of the present invention claimed hereinafter, which is limited to the verification device 108 devised for sensing a metallized security thread 100 embedded in, or associated with, documents 104 such as currency and banknote paper.

In a preferred embodiment, the security thread 100 is totally embedded within the currency paper 104 using conventional techniques. However, this is purely exemplary; it is to be understood that the security thread 100 may only be partially embedded at selected locations within the paper 104, or the thread 100 may be mounted on the surface of the document paper 104, either during or after the manufacture of such documents.

Referring to FIG. 3, there illustrated, in block diagram and schematic form, is a preferred embodiment of electronic circuitry 116 comprising the verification device 108 of the present invention. The device 108 is operable to scan a document 104, such as currency or banknote paper, and determine the presence or absence of a security thread 100 embedded in, or associated with the document, thereby determining the authenticity of the document.

The device 108 of the present invention comprises a sensor pad arrangement 112 comprising a single central sensing pad 120 flanked by an array of twenty-seven pairs of outer stimuli pads 124. Each pair of outer pads 124 in the array is electrically connected together. Every pad 120,124 comprises an electrically-conductive metallic material such as copper deposited on the surface of an insulative material, such as a fiberglass printed circuit board. The width dimension of each outer pad 124 in the array is several times greater than the width of the security thread 100. Also, each outer pad 124 in the array is preferably angled to improve the reliability of detection of the security thread 100 by preventing the thread from falling in between two adjacent pads 124. Each side of the central sensing pad 120 may be separated from the outer array pads 124 by corresponding guard electrodes connected to electrical ground. The guard electrodes reduce the effects of stray capacitance on the central sensing pad 120 and outer pads 124, thereby reducing the inadvertent coupling of an oscillator signal from the outer array pads into the central sensing pad.

FIG. 3 also illustrates the currency or banknote paper 104 of FIGS. 1–2 being directed to pass over (and typically in contact or close contact with) the sensor pad arrangement 112 in a wide edge leading direction. The arrowhead in FIG. 3*a* indicates the direction of travel of the paper 104 with respect to the sensor pad arrangement 112. The sensor pad arrangement is rectangular-shaped, and its width dimension is approximately equal to the width dimension of the rectangular-shaped currency paper. As can be inferred from FIG. 3*a* (yet described in detail hereinafter with respect to FIGS. 4–5), the security thread 100 (illustrated in phantom in FIG. 3*a*) passes over the central sensing pad 120 and at least one pair of outer pads 124 in the arrangement 112.

Each pair of outer array pads 124 is electrically connected together and to a corresponding one of twenty-seven oscillator signals ("OS1"–"OS27"). In an exemplary preferred embodiment, each oscillator signal is a square wave signal having a frequency of 4 MHz. The oscillator signals, OS1–OS27, are connected on corresponding signal lines with a programmable array logic ("PAL") integrated circuit, U6 128, which generates the oscillator signals in the desired sequence or pattern. The PAL, U6 128, may comprise the Model MACH210J, provided by Advanced Micro Devices. The PAL, U6, receives a square wave clock signal, EXTCLK, on a line 132 from an oscillator circuit, Q1 136, which may comprise the Model CTX166-ND, commercially-available. The clock signal, EXTCLK, has a frequency of 16 MHz. The PAL, U6 128, divides the clock signal by four to arrive at the 4 MHz frequency for each oscillator signal, OS1–OS27.

As the oscillator signals are applied to the outer array pads 124 in a pattern described in detail hereinafter, the pads with the signals applied thereto (i.e., the "stimulated" pads at that point in time) radiate the electrical energy at the 4 MHz frequency of the oscillator signals. This radiating energy dissipates into the surrounding environment. In the absence of the metallized security thread 100 (or other conductive material) from close proximity to the sensor pad arrangement 112, a small portion of this energy is coupled into the single central sensing pad 120. However, this energy is canceled out because the pattern of oscillator signals applied to the outer pads 124 is always such that there is an equal number of array pads 124 having the positive and negative voltage portions of the oscillator signal applied thereto. When a non-electrically-conductive material, such as the currency paper 104 itself, is across a stimulated pair of array pads 124 and also across the central sensing pad 120, a small but negligible amount of the energy radiated from the outer array pads is coupled the central sensing pad. It is only when an electrically-conductive material is present across a pair of stimulated array pads 124 that there is capacitive coupling of the corresponding oscillator signal into the central sensing pad 120. The central sensing pad thus provides a signal indicative of any capacitive coupling of the oscillator signals into the central sensing pad 120, thereby providing an indication of the presence or absence of the thread 100 from within the currency paper 104.

The single central sensing pad 120 is connected on a line to an inverting input of an operational amplifier ("OP-AMP"), U1 140, which may comprise the Model LM6361, commercially-available from Motorola. The op-amp, U1 140, amplifies the signal from the central sensing pad 120. The op-amp, U1 140, has several resistors, R1–R4, and a capacitor, C1, associated therewith. The values for all of the resistors and capacitors in the circuitry of FIG. 3 are given in Tables I and II, respectively.

TABLE I

| REF. NO. | RES. NO. | RES. VALUE |
|---|---|---|
| 142 | R1 | 20K |
| 144 | R2 | 20K |

TABLE I-continued

| REF. NO. | RES. NO. | RES. VALUE |
|---|---|---|
| 146 | R3 | 10K |
| 148 | R4 | 51 |
| 150 | R5 | 470 |
| 152 | R6 | 22K |
| 154 | R7 | 10K |
| 156 | R8 | 10K |
| 158 | R9 | 4.7K |
| 160 | R10 | 4.7K |
| 162 | R11 | 4.7K |
| 164 | R12 | 20K |
| 166 | R13 | 1K |
| 168 | R14 | 10K |

TABLE II

| REF. NO. | CAP. NO. | CAP. VALUE |
|---|---|---|
| 170 | C1 | 0.1 uf |
| 172 | C2 | 0.001 uf |
| 174 | C3 | 0.001 uf |
| 176 | C4 | 0.1 uf |
| 178 | C5 | 330 pf |
| 180 | C6 | 0.1 uf |
| 182 | C7 | 0.01 uf |
| 184 | C8 | 10 uf |
| 186 | C9 | 3300 pf |
| 188 | C10 | 1.0 uf |
| 190 | C11 | 0.1 uf |
| 192 | C12 | 0.1 uf |
| 194 | C13 | 0.1 uf |
| 196 | C14 | 22 uf |
| 198 | C15 | 22 uf |
| 200 | C16 | 0.01 uf |
| 202 | C17 | 0.1 uf |

The signal output, RFIN, of the op-amp, U1 140, on the line 204 is connected to an input of an application specific integrated circuit ("ASIC"), U2 208, which may comprise the Model CAL160, provided by Calogic Corporation, Fremont, Calif. The circuitry within the ASIC 208 may be similar to that described and illustrated in U.S. Pat. No. 5,535,871, which is hereby incorporated by reference. The ASIC, U2 208, contains a synchronous modulator/demodulator circuit, similar to that illustrated in FIG. 7*a* of the aforementioned U.S. Pat. No. 5,535,871, which processes the signal, RFIN, from the central sensing pad 120 and provides a single-ended analog output signal on pin 10 of the ASIC 208. This analog signal contains voltage pulses above and below a quiescent (steady state) point. The pulses and their voltage levels or phases are indicative of capacitive coupling of the oscillator signals into the central sensing pad 120.

The output signal from pin 10 of the ASIC on a signal line is provided to a filter circuit, comprised of resistors, R9–R11 158–162, and capacitors, C8–C9 184–186. The filter output signal, OUT, on a line 216 is fed to pin 2 of an 8-bit microcontroller integrated circuit, U3 220, illustrated in FIG. 3*b*, which may comprise the Model PIC16C73, provided by Microchip Technology Inc. of Chandler, Ariz. The microcontroller, U3 220, contains 4 K of EPROM program memory, 256 8-bit general-purpose registers, a serial interface, three byte-wide (i.e., 8-bit wide) general purpose input/output ("1/O") ports, and an analog-to-digital converter.

Figure 3A:
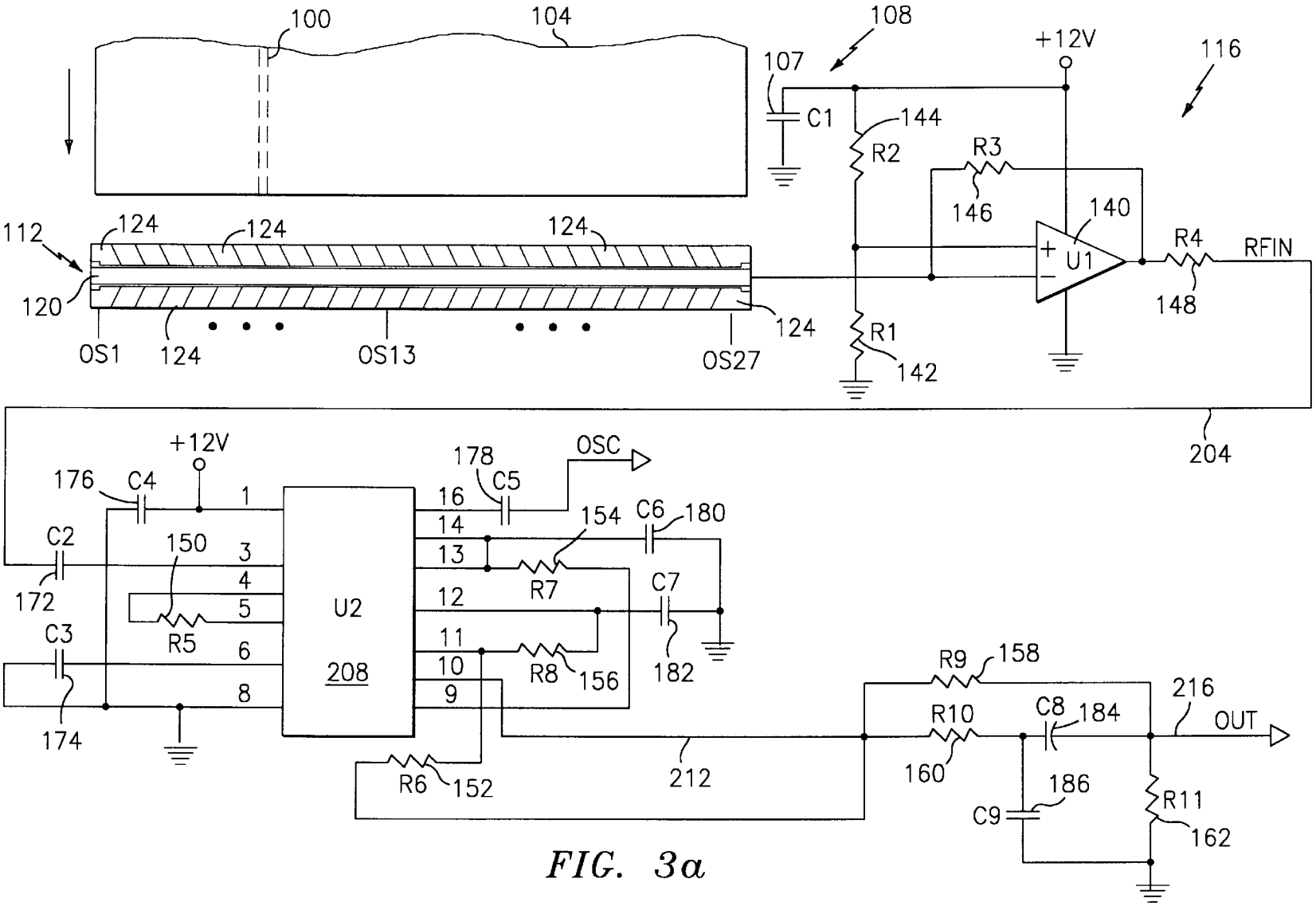
FIG. 3, including FIGS. 3*a–d,* is a block diagram and schematic illustration of the security thread verification device of the present invention, and also illustrating the currency paper of FIG. 1 with respect to a sensing pad arrangement of the device of the present invention.
Figure 3B:
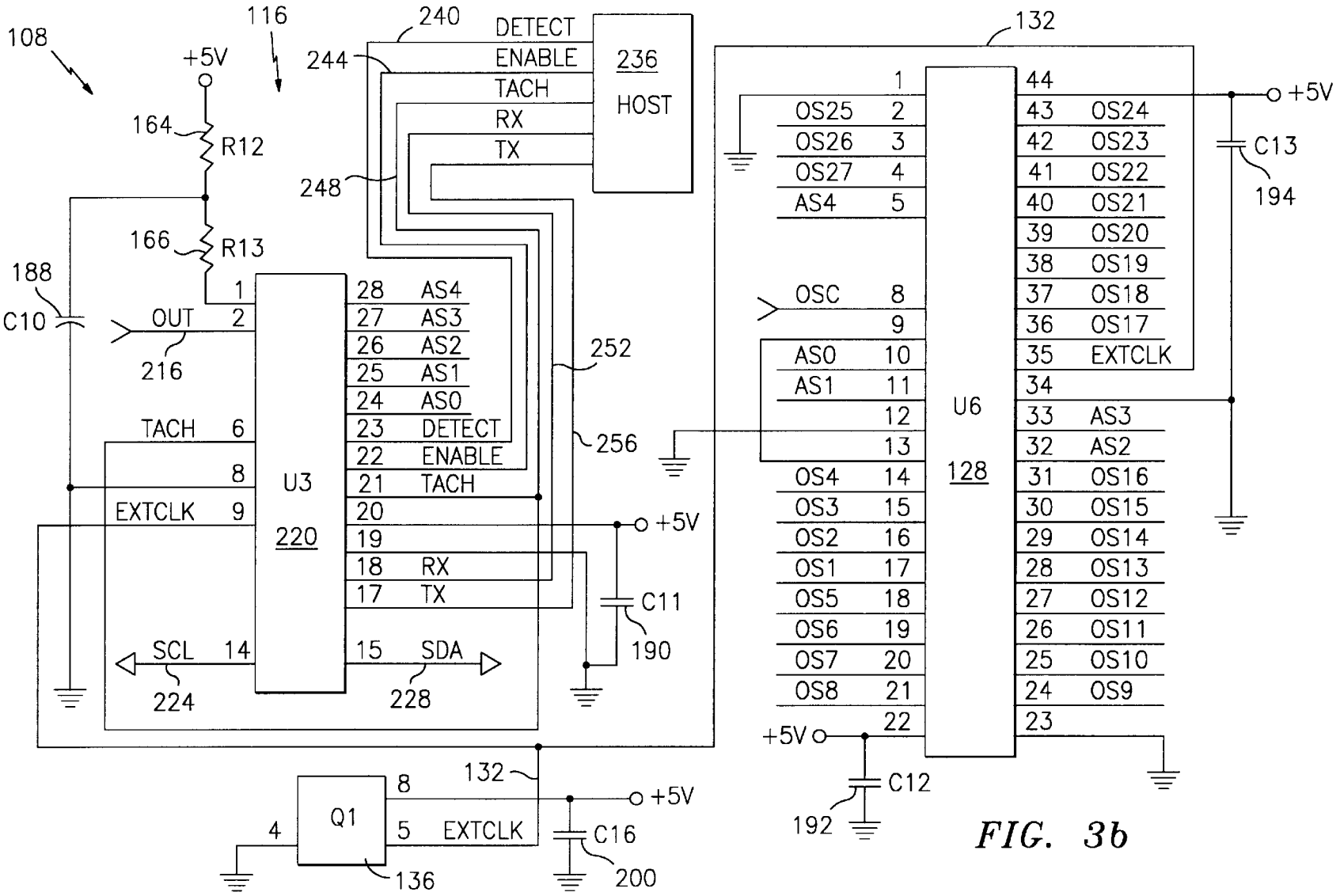
Figure 3C:
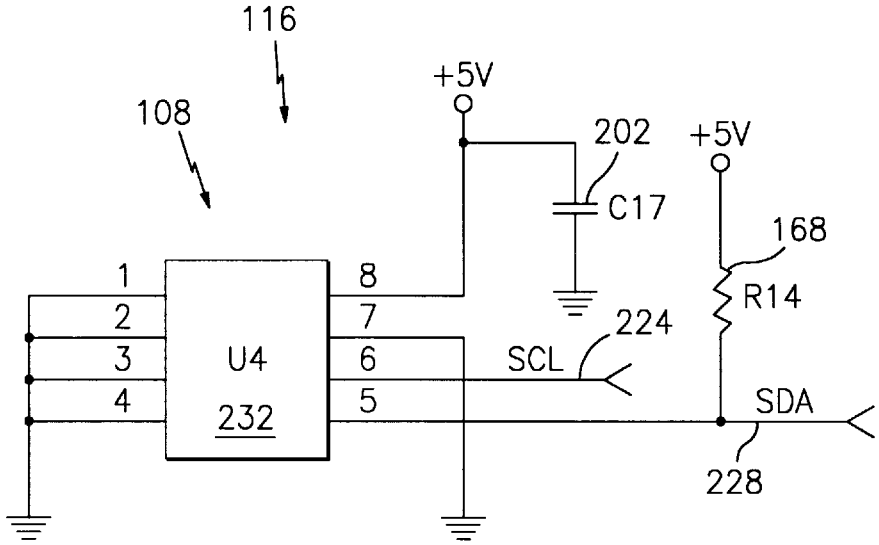
Figure 3D:
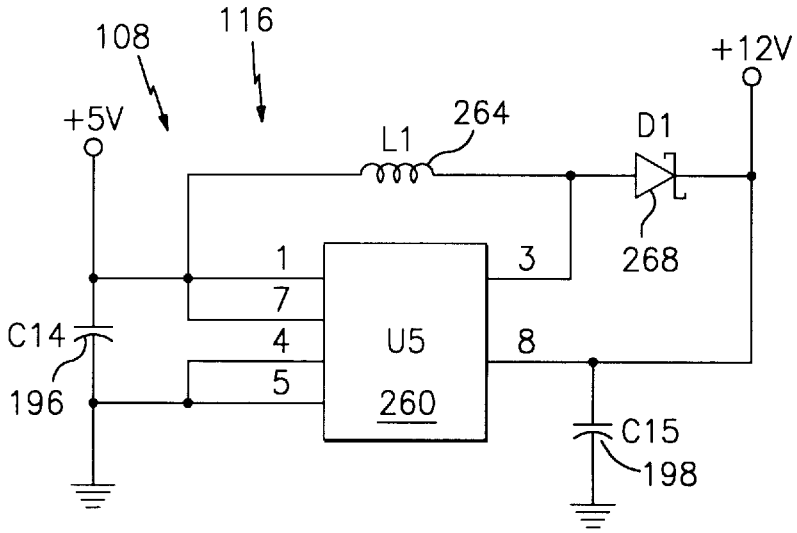

Two I/O signals, SCL ("serial clock") and SDA ("serial data"), connect over corresponding signal lines 224–228 to a writable non-volatile memory integrated circuit, U4 232, illustrated in FIG. 3*c,* which may comprise the Model 24C02A/SN, provided by Microchip Technology Inc. of Chandler, Ariz. The memory circuit 232 stores changeable program parameters utilized by the software program executed by the microcontroller, U3 220. The microcontroller has a software program stored in its internal EEPROM memory for processing the analog output signal, OUT, and for directing the operation of other components in the circuitry 116 of FIG. 3. An exemplary embodiment of a portion of the software program is illustrated in flowchart form in FIGS. 7–8, and is described in detail hereinafter. The 16 MHz signal, EXTCLK, from the oscillator, Q1 136, is input to pin 9 of the microcontroller, U3 220.

The microcontroller, U3 220, also provides for data communication over an 8-bit data bus. Five signals of the data bus are address signals, AS0–AS4, that connect with the PAL, U6 128. These address signals select the ones of the twenty-seven oscillator signals, OS1–OS27, to be applied to the outer array pads 124. The other three signals of the data bus connect with an external host system 236. In the preferred exemplary embodiment described herein, the host system 236 comprises a high-speed currency counter. Other host systems may be utilized, such as high-speed currency sorters/counters, and stand-alone bill acceptors/changers that verify the authenticity and denomination of currency paper 104. Typically, the host system 236 contains its own electronics (not shown) for carrying out the functions associated with that particular device. It should be understood that the host system forms no part of the present invention.

One signal, DETECT, connected with the host 236, is an output signal on a line 240 from the microcontroller, U3 220, and indicates to the host whether a valid security thread 100 has been detected by the circuitry 116 of FIG. 3. Another signal, ENABLE, on a line 244 is input from the host 236 and is typically indicative of a sensed condition where the host has detected the presence of a document 104 in a mechanical transport that is part of the host. The ENABLE signal tells the circuitry 116 of FIG. 3 that a document 104, such as a dollar bill, is about to transported past the sensor pad arrangement 112 of FIG. 3. This signal is typically generated by a photodetector that is a part of the circuitry of the host. The microcontroller, U3 220, continuously monitors the ENABLE signal and begins data collection and analysis when the signal is at its active logic state. The third signal, TACH, on a line 248 is also provided by the host 236 and is typically indicative of how fast the document is being transported by the host. If the host is a currency counter, the TACH signal is typically generated by the encoder drive wheel.

The serial interface on the microcontroller, U3 220, receives a serial data input signal, RX, on a line 252 from the host 236. The microcontroller 220 also transmits a serial data signal, TX, on a line 256 to the host. The serial interface may be optionally used to output sensor scan results and provide diagnostic and maintenance access to the device 108 by the host.

Electrical power in the form of +5VDC may be provided to the circuitry 116 of FIG. 3 by the host. In the alternative, +5VDC may be provided by a power source internal to the device, such as one or more batteries. A voltage converter, U5 260, illustrated in FIG. 3*d,* converts the +5VDC into +12VDC for use by the circuitry 116 of FIG. 3. The voltage converter, U5 260, may comprise the Model LT1109, provided by Linear Tech Corp., of Millipitas, Calif. The circuitry associated with the voltage converter, U5 260, includes an inductor, L1 264, whose value may be 33 microhenries, and a diode, D1 268, which may comprise the Model 1N5818, commercially-available.

Referring to FIG. 4, there illustrated is the security thread 100 (shown in phantom) in relation to the sensor pad arrangement 112 of FIG. 3. For sake of clarity and for illustration of an exemplary common situation that occurs when scanning a currency paper 104 having a metallized security thread 100, the sensor pad arrangement 112 shown in FIG. 4 has only eight pairs of outer array pads 124. Also, these pads are shown as having a square shape, instead of angled as in FIG. 3.

Figure 4B:
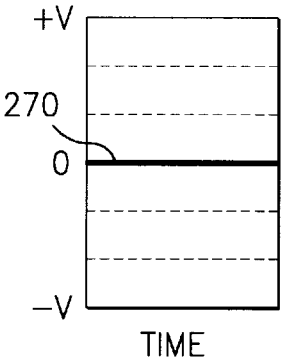
FIG. 4, including FIGS. 4*a–j,* illustrates a first position of the security thread with respect to the sensor pad arrangement of the device of FIG. 3, together with corresponding waveforms of the resulting sensed signal at various points in time.
Figure 4D:
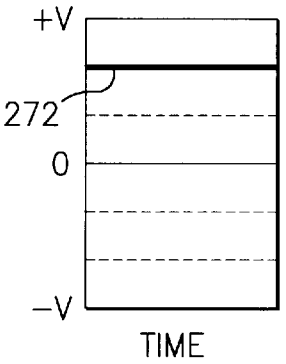
Figure 4F:
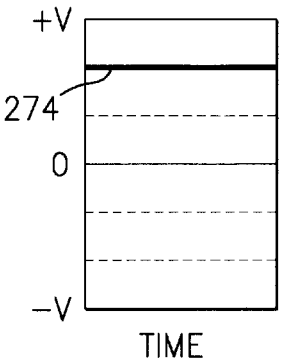
Figure 4H:
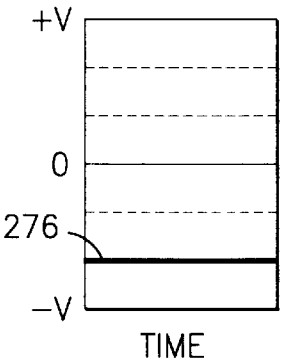
Figure 4J:
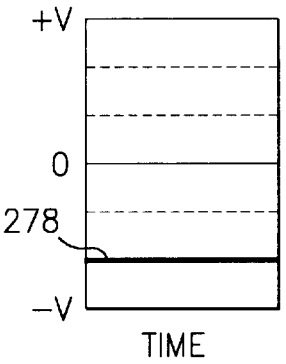
Figure 4A:
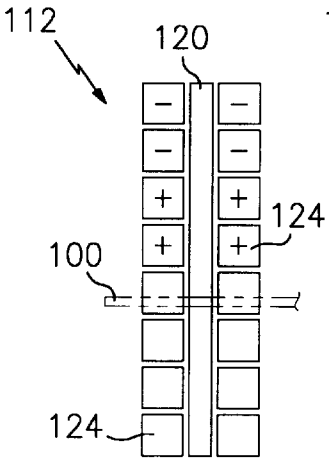

In FIG. 4*a,* two adjacent pairs of outer array pads 124 are designated with a "+" symbol, while two other adjacent pairs of outer array pads 124 are designated with a "−" symbol. Throughout the discussion herein with respect to FIGS. 4–6, the "+" symbol refers to the positive voltage portion (i.e., positive phase) of the corresponding ones of the square wave oscillator signals ("OS1"–"OS27") being applied to the pads 124 designated with the "+" symbol. In a similar manner, the "−" symbol refers to the negative voltage portion (i.e., negative phase) of the corresponding ones of the square wave oscillator signals being applied to those pads 124 designated with the "−" symbol. From FIGS. 4*a*, 4*c*, 4*e*, 4*g* and 4*i,* it can be seen that the pattern of the oscillator signals applied to the outer array pads 124 is such that four adjacent pairs of pads have the signals applied thereto at any point in time. The signals are sequenced from top to bottom when viewing these figures from left to right on the page. Once the "+" signals reach the bottom of the array (as in FIG. 4*i*), the signals are then routed back to the top of the array, as in FIG. 4*a,* with no "wrap-around" of the signals.

Those outer array pads 124 without any "+" or "−" designation have no oscillator signals applied thereto at that particular point in time illustrated (i.e., they are not stimulated). FIG. 4 also illustrates the position of the security thread 100 with respect to a pair of outer array pads 124. In FIG. 4, the thread 100 is moving from left to right across the sensor pad arrangement 112 as the document 104 containing the thread is moved in a similar direction. Also, in FIG. 4, because the width of the thread 100 is smaller than the width of each one of the outer array pads 124, the thread is positioned adjacent to (i.e., in contact with, or in near contact with) only one pair of pads. FIGS. 4*b*, 4*d*, 4*f*, 4*h* and 4*j* illustrate waveforms 270–278 of the corresponding voltage polarity (i.e., "+" or "−"), or phases, of the signal induced on the central sensing pad 120 due to capacitive coupling of the oscillator signals into the central sensing pad. FIGS. 4*b*, 4*d*, 4*f*, 4*h* and 4*j* correspond to the patterns shown in FIGS. 4*a*, 4*c*, 4*e*, 4*g* and 4*i,* respectively.

Referring specifically to FIGS. 4*a* and 4*b,* it can be seen that no oscillator signals are applied to the specific pair of outer array pads 124 that the security thread 100 is adjacent to. Thus, there is no signal capacitively coupled into the central sensing pad 120. This is reflected by the zero ("0") voltage level shown in the waveform 270 of FIG. 4*b.*

Figure 4C:
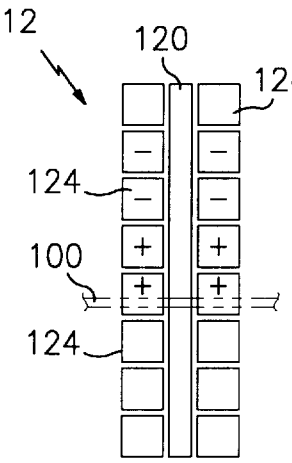
Figure 4E:
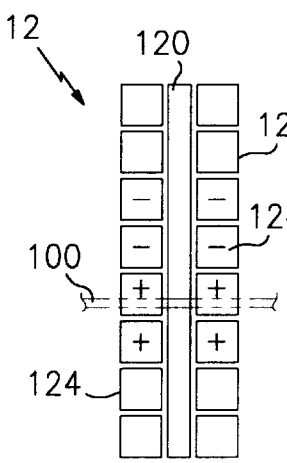

In FIG. 4*c,* the pattern of oscillator signals has been sequenced down the array such that now a positive phase is applied to the pair of outer array pads 124 that the metallic security thread 100 is adjacent to. The thread now "bridges" or capacitively couples the positive phase of the square wave oscillator signal into the central sensing pad 120. This is seen in the waveform 272 of FIG. 4*d,* which illustrates a positive voltage level on the central sensing pad 120. FIGS. 4*e* and 4*f* illustrate a similar positive phase on the central sensing pad as the pattern is sequenced down the array.

Figure 4G:
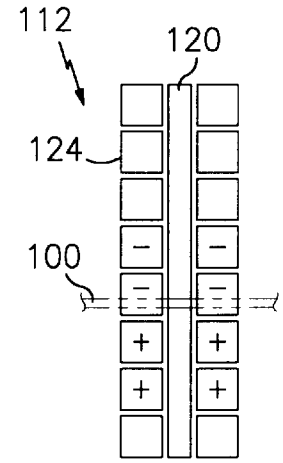
Figure 4I:
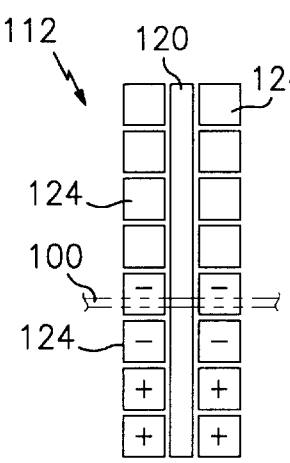

In FIG. 4*g,* the pattern is sequenced down the array such that the thread 100 capacitively couples the negative phase of the square wave oscillator signal into the central sensing pad 120. This is seen in the waveform 276 of FIG. 4*h*. FIGS. 4*i* and 4*j* illustrate a similar situation. After the sequence shown in FIG. 4*i*, the pattern repeats back to that shown in FIG. 4*a*.

The signal processing electronics 116 of FIG. 3 processes the signal on the central sensing pad 120 and determines a valid security thread 100 therefrom. The signal processing software is discussed in detail hereinafter with respect to the flowcharts of FIGS. 7–8. However, it can be seen that since a bilevel voltage signal (i.e., a signal having both "+" and "–" excursions or phases) is applied to the outer array pads 124 and sensed by the central sensing pad 120, a necessary condition for the determination of a valid security thread 100 is the existence of a similar bilevel voltage signal on the central sensing pad 120. A further condition for a valid security thread 100 may be that the output signal has a positive voltage level for two cycles of the pattern, and then has a negative voltage level for two cycles of the pattern, wherein the two negative voltage level cycles occur in time right after the two positive voltage level cycles. This latter sequence in the output signal can be seen from the pattern of the signal applied to the outer array pads 124.

Referring to FIG. 5, there illustrated is a sensor pad arrangement 112 and resulting output voltage waveforms 280–288 similar to that shown in FIG. 4. Similar to FIG. 4, the sensor pad arrangement 112 of FIG. 5 illustrates outer array pads 124 that are straight, not angled as in FIG. 3. FIG. 5 illustrates the situation where the security thread 100 is in between two pairs of outer array pads 124. In a preferred exemplary embodiment, the width of the security thread 100 is greater than the spacing between any two adjacent outer array pads 124. Therefore, in the situation illustrated in FIG. 5, a small portion of the thread 100 overlaps two adjacent pads.

Figure 5B:
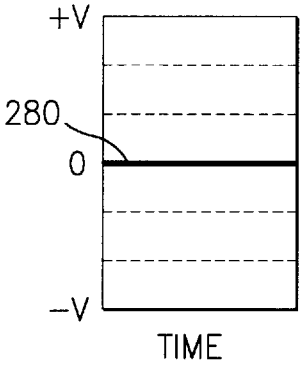
FIG. 5, including FIGS. 5*a–j,* illustrates a second position of the security thread with respect to the sensor pad arrangement of the device of FIG. 3, together with corresponding waveforms of the resulting sensed signal at various points in time.
Figure 5D:
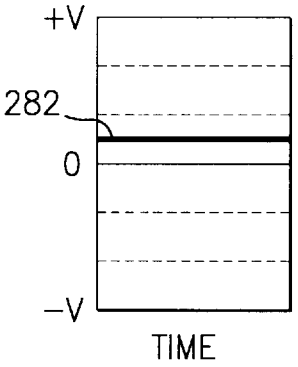
Figure 5F:
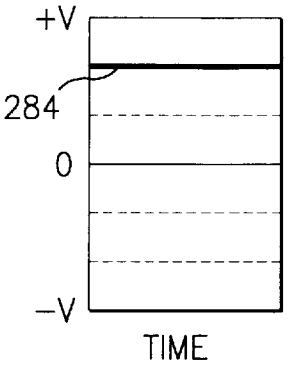
Figure 5H:
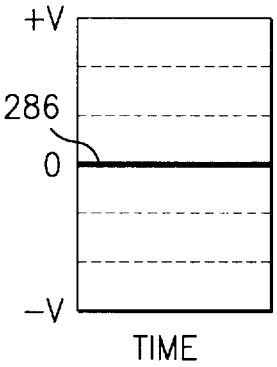
Figure 5J:
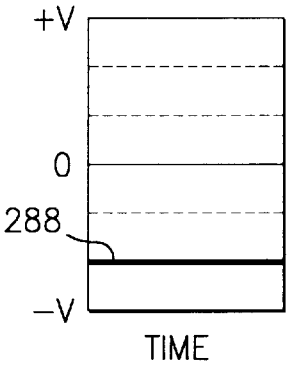
Figure 5A:
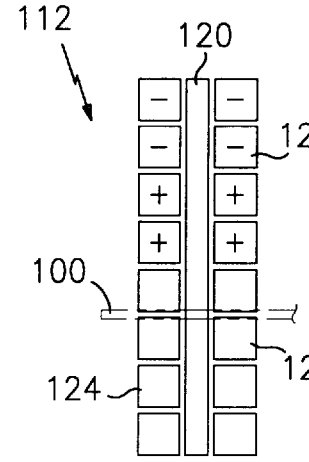
Figure 5C:
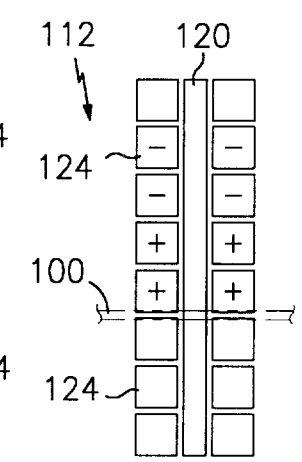

In FIGS. 5*a* and 5*b*, it can be seen that no oscillator signals are applied to the two specific pairs of outer array pads 124 that the security thread 100 overlaps. Thus, there is no signal capacitively coupled into the central sensing pad 120. This is reflected by the zero ("0") voltage level shown in the waveform 280 of FIG. 5*b*. FIGS. 5*c* and 5*d* illustrate the situation where only one pair of outer array pads 124 having a positive voltage level signal is slightly overlapped by the thread 100. This results in the thread capacitively coupling only a relatively small amount of the positive phase of the oscillator signal into the central sensing pad 120. Thus, a correspondingly small positive voltage level is seen in the waveform 282 of FIG. 5*d*.

Figure 5E:
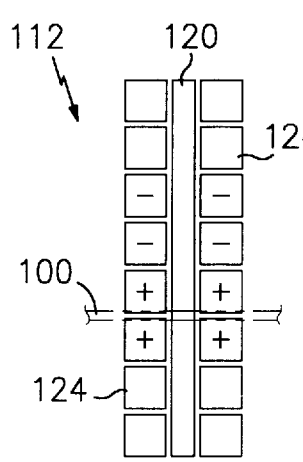

FIGS. 5*e* and 5*f* illustrate the situation where both pairs of outer array pads 124 overlapped by the thread 100 have the positive phase applied thereto. The result is a relatively large amount of the oscillator signal being capacitively coupled into the central sensing pad 120. This is reflected in the relatively large positive voltage level seen in the waveform 284 of FIG. 5*f*.

Figure 5G:
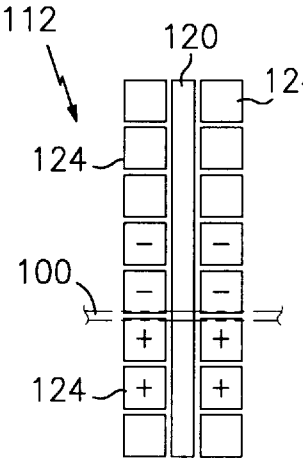

In FIG. 5*g*, one pair of outer array pads 124 overlapped by the thread 100 has a positive phase of the oscillator signal applied thereto, while the adjacent pair of outer array pads overlapped by the thread has a negative phase of the oscillator signal applied thereto. The thread 100 capacitively couples each of the two opposite voltage level signals in equal amounts to the central sensing pad 120. The result is that the two coupled signals cancel each other out at the central sensing pad, as seen by the zero voltage value in the waveform 286 of FIG. 5*h*.

Figure 5I:
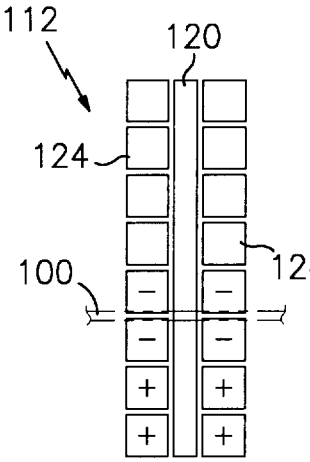

Finally, FIG. 5*i* illustrates a situation similar to that in FIG. 5*e*, except that now the two pairs of outer array pads 124 overlapped by the thread 100 have a negative phase applied thereto. This results in a relatively strong negative voltage output in the waveform 288 of FIG. 5*j*.

It can be seen from FIG. 5 that even with the thread 100 overlapping only a small portion of the outer array pads 124, a detectable signal indicative of a valid security thread 100 may be obtained using the pattern of oscillator signal excitation described herein.

Referring to FIG. 6, there illustrated is the situation where a portion of a paper document 104 overlies several pairs of outer array pads 124. No metallized security thread 100 overlaps any of the outer array pads. In all other respects, FIG. 6 is similar to FIGS. 4–5. As mentioned hereinbefore, paper has significantly different dielectric properties than those of metal. In particular, paper is a relatively poor electrical conductor, compared to metal. Nevertheless, the paper document 104, such as currency or banknote paper, has enough differential conductivity to bridge the oscillator signals into the central sensing pad 120, thereby causing a detectable signal. However, the pattern of oscillator signals applied to the outer array pads 124 causes only a unipolar signal (i.e., a signal with only either a positive or a negative voltage level) to be output onto the central sensing pad 120.

Figures 6B, 6D, 6F, 6H, 6J:
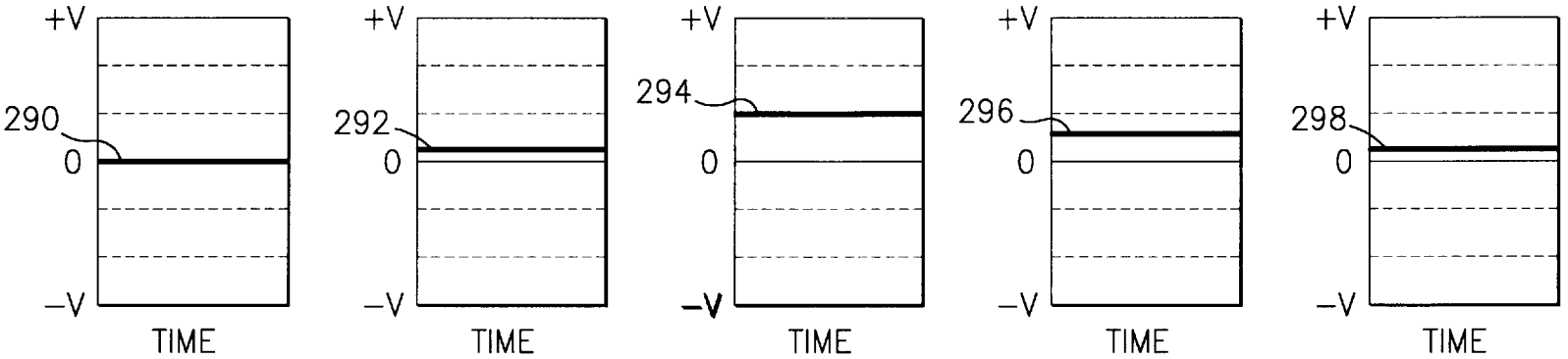
FIG. 6, including FIGS. 6*a–j,* illustrates the position of a paper document with respect to the sensor pad arrangement of the device of FIG. 3, together with corresponding waveforms of the resulting sensed signal at various points in time.
Figures 6A, 6C, 6E, 6G, 6I:
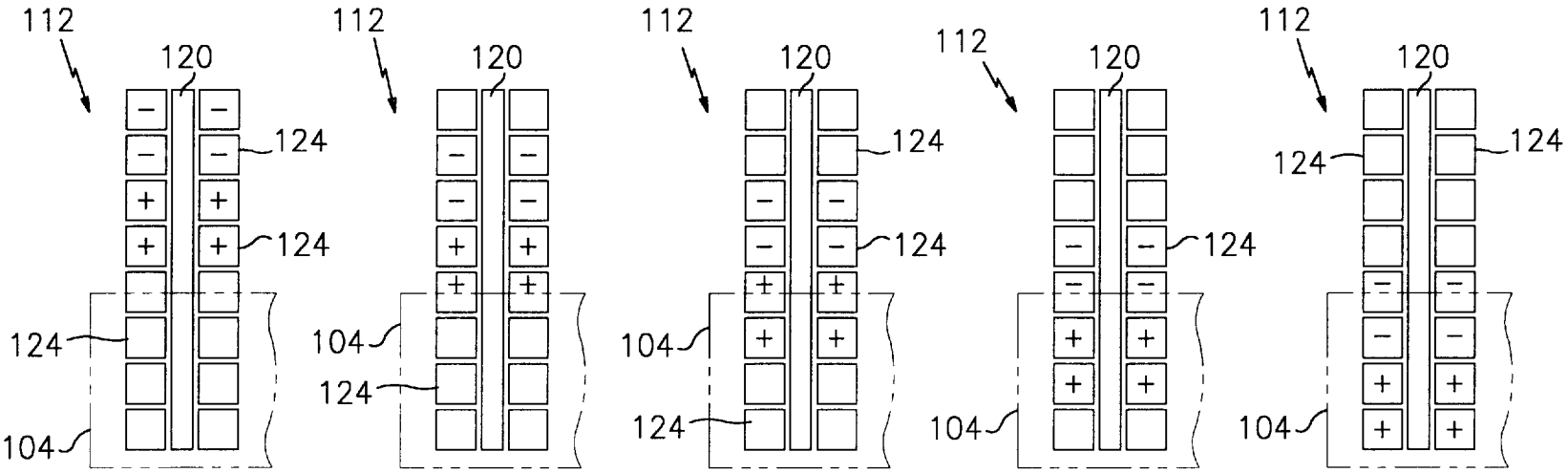

In FIG. 6*a*, no pair of outer array pads 124 overlaid by the document have an oscillator signal applied. Thus, there is no signal capacitively coupled into the central sensing pad 120. The waveform 290 of FIG. 6*b* reflects this zero voltage output condition. In FIG. 6*c*, a portion of a pair of outer array pads 124 having a positive phase of the oscillator signal applied is covered by the document 104. This results in a small, yet detectable amount of the oscillator signal coupled into the central sensing pad 120, as shown in the waveform 292 of FIG. 6*d*.

In FIG. 6*e*, the document 104 now fully covers one pair of pads 124, and partially covers another pair of pads having the positive phase of the oscillator signal applied thereto. This results in a relatively greater voltage seen in the waveform 294 of FIG. 6*f*.

In FIG. 6*g*, the document 104 now fully covers two pairs of pads 124 with the positive phase of the oscillator signal, while also partially covering a pair of pads having the negative phase of the oscillator signal applied thereto. The negative signal partially cancels out the positive signal. The result is a positive voltage waveform 296, as seen in FIG. 6*h*.

Finally, FIG. 6*i* illustrates the document 104 fully covering two pairs of pads 124 with the positive phase of the oscillator signal and one pair of pads with the negative phase of the oscillator signal, while also partially covering one pair of pads with the negative phase. The overall result is a positive voltage signal, as seen in the waveform 298 of FIG. 6*j*.

It can be seen from FIG. 6 that a paper document 104 only produces positive voltage levels on the central sensing pad 120, even though both positive and negative voltage phases of the oscillator signals were applied to the outer array pads 124. It is the sequencing of those oscillator signals that causes only a unipolar (i.e., a positive) voltage signal to be produced on the central sensing pad. Thus, the pattern utilized does not allow artifacts, such as paper documents or counterfeit threads, to incorrectly cause the verification device 108 of the present invention to determine such artifacts to be a authentic security thread.

Figure 7:
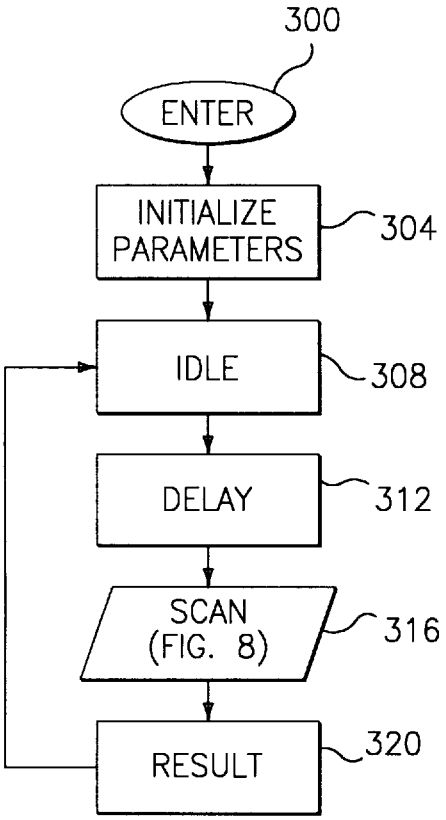
FIG. 7 is a flowchart illustration of a portion of software executed by a signal processor that is part of the device of FIG. 3.

Referring now to FIG. 7, there illustrated is a flowchart of software executed by the microcontroller, U3 220, in carrying out the basic functions of the verification device 108 of the present invention. These functions include document scanning, sensor pad data acquisition, data analysis for thread presence, and I/O monitoring and control. The software may be implemented by assembly language instructions stored in the on-board EEPROM memory of the microcontroller, U3 220, with the software sometimes commonly being referred to as firmware. In a preferred embodiment, the firmware is embodied as a state machine, to provide effective timing and control of sensor data acquisition, analysis and results. Generally, state transitions are based upon input from the active states of the ENABLE or TACH input signals from the host 236, and the system clock. State transition processing will alter the process state and perform any state change-related activity, such as updating outputs or transmitting serial messages.

The flowchart of FIG. 7 illustrates a software state machine that the microcontroller, U3 220, operates in the scan mode of operation of the verification device 108. After an enter step 300 in FIG. 7, a routine 304 is executed wherein a number of operating parameters are initialized. These parameters may be stored in the non-volatile, writable memory component, U4 232. These parameters may include the size of EEPROM, an EEPROM checksum, a delay time after the ENABLE signal becomes active from the host, and a minimum usable dynamic threshold.

Once parameter initialization is complete, an idle state 308 is entered in which the microcontroller, U3 220, waits for an active transition of the ENABLE signal line 244 from the host 236, indicating the beginning of a scan period of time. Once this signal transition is detected, a delay state 312 is entered in which the microcontroller, U3 220, may be configured to delay for a period of time before initiating scanning of the sensor pad arrangement 112 by applying the oscillator signals, OS1–OS27, onto the pairs of outer array pads 124 in the predetermined pattern. The delay time may be specified in a stored parameter as either system clock ticks or tachometer pulses. If this parameter is set, the microcontroller 220 will delay for the specified period of time before transitioning to the next state, the scan state 316.

Figure 8:
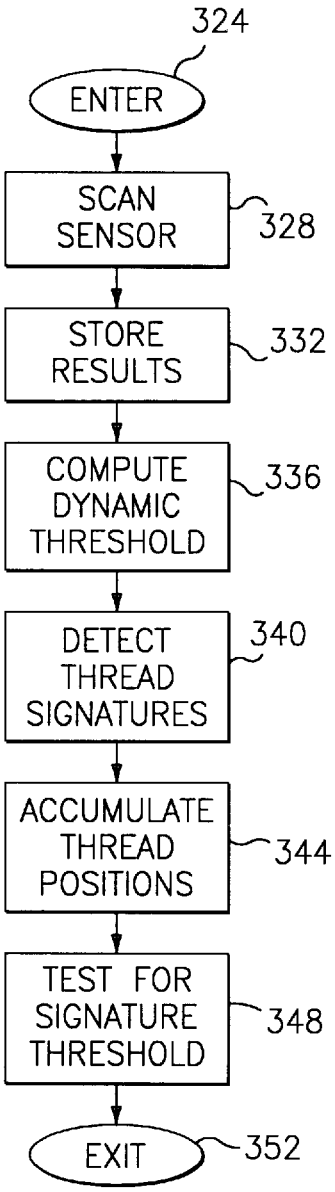
FIG. 8 is another flowchart illustration of a portion of software executed by the signal processor of the device of FIG. 3.

In the scan state 316, the microcontroller, U3 220, controls the application of the oscillator signals to the outer array pads 124 and processes the resulting sensed signal on the central sensing pad 120. The detailed steps executed by the microcontroller 220 in the scan state 316 are illustrated in the flowchart of FIG. 8, described in detail hereinafter. Nevertheless, in the scan state 316, the microcontroller 220 collects and analyzes the sensed data on the central sensing pad 120 until a completion condition occurs. This condition may be N clock ticks, tachometer pulses or a change in state of the ENABLE signal line 244. Whatever condition chosen, the completion condition is set long enough to insure that the entire sensor pad arrangement 112 is scanned. The condition that applies is selected by the stored configuration parameters. If tachometer input is specified, this state will time-out on tachometer failure.

After the scan state is completed, a result state 320 is entered in which the accumulated data is analyzed for the presence of a valid thread 100 and a result posted. The DETECT signal 240 is set accordingly for a suitable period of time (e.g., until the start of the next scan cycle) and a serial data message may optionally be transmitted. The state machine then transitions back to the idle state 308 to wait for an ENABLE signal 244 from the host 236 to begin the next data accumulation and processing cycle.

Referring to FIG. 8, there illustrated is a flowchart of steps executed by the microcontroller, U3 220, while in the scan state 316 of FIG. 7. After an enter step 324, the microcontroller, U3 220, and the PAL, U6 128, scan the sensor pad arrangement in a routine by controlling the pattern of application of the twenty-seven oscillator signals, OS1–OS27, to the corresponding twenty-seven pairs of outer array pads 124. In a preferred embodiment, the pattern may be similar to that described hereinbefore with respect to FIGS. 4–6. However, other patterns may be utilized, which should be obvious to one or ordinary skill in the art, in light of the teachings herein. For example, instead of applying the positive phase of the square wave signal to two adjacent pairs of pads 124, that phase may be applied to only one pair of pads, or three or more adjacent pairs of pads. Similar variations may be utilized with the negative phase. Alternatively, the patterns may comprise an alternating sequence of positive-negative-positive-negative, etc. All of these variations are contemplated by the broadest scope of the present invention.

Further, the sensor pad arrangement 112 has been described as comprising a central sensing pad 120 flanked on either side by an array of a plurality of outer pads 124 having the oscillator signals applied thereto. However, it is to be understood that this sensor pad arrangement is purely exemplary; other arrangements may be utilized, in light of the teachings herein, while remaining within the broadest scope of the present invention. For example, the sensor pad arrangement 112 may comprise a central sensing pad 120 flanked on only one side by an array of oscillator pads 124. In this situation, the pattern of oscillator signals described with respect to FIGS. 4–6 may still be utilized. However, other patterns may also be utilized. Alternatively, the functions of the pads 120–124 may be reversed. That is, the central pad 120 may have an oscillator signal applied thereto while the outer array pads 124 may comprise the sensing pads.

Nevertheless, after each sequence of application of the oscillator signals in the pattern, the resulting signal on the central sensing pad 124 is sampled by the analog-to-digital converter in the microcontroller, U3 220, and converted to a digital value. These digital values are then stored, in a step 332, in the RAM memory on board the microcontroller, U3 220.

The data stored in RAM represents raw data, from which a dynamic threshold value is calculated, in a routine 336. A threshold is calculated due to the different strengths of the signal on the central sensing pad 120 that are typically encountered by the verification device 108 of the present invention. In a preferred embodiment, a percentage of the normalized raw data peak value is used as the threshold. The percentage may be stored as an EEPROM parameter that is initialized by the device user. Alternatively, the percentage may be set from the serial interface. The computed threshold may be compared with a minimum threshold parameter and the larger number used as the scan threshold.

Next, the raw data is analyzed for thread signatures in a routine 340. A valid thread signature interpreted from the raw data may be a specific over-threshold pattern in a grouping of three or four adjacent data values, or "cells". A valid pattern may be a sequence of "++−−" voltage phases (where the "+" symbol indicates a positive voltage in the waveform, and a "−" symbol indicates a negative voltage in the waveform), in the output voltage waveform (e.g., FIGS. 4*d*, 4*f*, 4*h* and 4*j*). In the alternative, a valid pattern may be a sequence of "−+−" voltage phases. Typically, this portion of the software will scan across the raw data until a positive over-threshold value is detected. If the next three of four "cells" match one of the two aforementioned patterns, then a valid thread signature is determined to be present at that location of the sensor pad arrangement 112.

Next, each time a valid thread signature is detected, a position in an accumulator array is incremented, in a step 344, for that location of the sensor pad arrangement 112. This array keeps track of detected thread signatures over multiple scans.

When the scanning period is complete, the accumulator array is evaluated for values in excess of the signature threshold in a routine 348. To detect threads whose positions are skewed with respect to the sensor pad arrangement 112, a stored EEPROM parameter defines the number of adjacent cells that may be accumulated for this comparison. If a thread is detected the DETECT output signal 240 is enabled, and the location is recorded in a bit mapped value. The scan routine of FIG. 8 then exits in a step 352.

Besides detecting for the presence of a valid security thread 100, as described hereinbefore, the microcontroller, U3 220, also contains firmware the monitors the serial input port for command messages from the host 236. These messages may include diagnostic and maintenance messages. When a complete message is detected from the host, a response message is transmitted back to the host. Optionally, the microcontroller, U3 220, may transmit scan results in a status message after each scan period.

The sensor pad arrangement 112 of the verification device 108 of the present invention has been described as having twenty-seven pairs of outer array pads 124. However, this number of pads is purely exemplary. Any number of pairs of outer array pads may be utilized in carrying out the broadest scope of the present invention. The ultimate number of outer array pads 124 utilized depends upon the width of the security thread 100 employed and the size of the document 104 into which the thread is placed. Theoretically, the width of each pair of outer array pads 124 should be greater than the width of the thread 100. This allows for proper sensing of the thread and less complicated signal processing schemes. Also, if the position of the thread within the document could vary, the sensor pad arrangement 112 should have an overall width that is as least as wide as the leading edge of the document 104 (or the largest document, if different-width documents are to be sensed by a single arrangement 112). Further, if the overall position of the document 104 with respect to the sensor pad arrangement 112 can vary, then the sensor pad arrangement 112 should be wide enough (and, thus, have a sufficient number of pairs of outer array pads 124) to sense all possible positions of the documents.

The verification device 108 of the present invention has been described as utilizing a square wave oscillator signal having both positive and negative voltage phases. That is, the positive and negative voltage levels are 180 degrees out-of-phase from each other. However, it is to be understood that this is purely exemplary. Other phase relationships may be utilized, in view of the broadest scope of the invention and the teachings herein. However, it is anticipated that something other than a 180 degree phase relationship may cause an increase in the complexity of the signal processing needed to discriminate a valid security thread 100 from a counterfeit thread as a result of processing of the signal capacitively coupled onto the central sensing pad 120.

Also, other shapes of oscillator signals besides a square wave signal may be utilized within the broadest scope of the present invention. For example, a sine wave or sawtooth signal may be used. In addition, whatever shape of signal chosen does not have to have both positive and negative phases. Instead, the signal could have solely positive or negative voltage levels. It suffices that the oscillator signal utilized have at least two distinctly different levels, so that these different levels appear in the signal output on the central sensing pad.

It should be understood by those skilled in the art that obvious structural modifications can be made to the embodiments described and illustrated herein without departing from the scope of the invention. Accordingly, reference should be made primarily to the accompanying claims, rather than the foregoing specification, to determine the scope of the invention.

Having thus described the invention, what is claimed is:

1. A device for verifying the authenticity of a document having a security thread associated therewith, the device comprising:

a. at least two pairs of outer array pads having an oscillator signal selectively applied thereto;

b. at least one sensing pad, a first one of the outer array pads in each pair being disposed on a first side of the at least one sensing pad, a second one of the outer array pads in each pair being disposed on a second side of the at least one sensing pad; and c. signal processing means, for selectively applying the oscillator signal to at least one of the at least two pairs of outer array pads, the oscillator signal having at least two different characteristics, for sensing any capacitive coupling of the oscillator signal into the at least one sensing pad, and for determining the presence of an authentic security thread associated with the document from a condition where the at least two different characteristics of the oscillator signal are capacitively coupled from at least one of the at least two pairs of outer array pads into the at least one sensing pad.

2. The device of claim 1, wherein the at least two different characteristics of the oscillator signal comprise two different voltage levels.

3. The device of claim 1, wherein the at least two different characteristics of the oscillator signal comprise two different voltage levels of opposite phase.

4. The device of claim 1, wherein the second side of the at least one sensing pad is opposite the first side of the at least one sensing pad.

5. The device of claim 1, wherein the signal processing means further comprises means for selectively applying the oscillator signal to the at least two pairs of outer array pads in a predetermined pattern, and for determining the presence of an authentic security thread associated with the document from a condition where the at least two different characteristics of the oscillator signal are capacitively coupled from the at least two pairs of outer array pads into the at least one sensing pad in the predetermined pattern.

6. The device of claim 5, wherein the predetermined pattern comprises a selective application of the oscillator signal to the at least two pairs of outer array pads in a sequence such that at least a first two outer array pads on the opposing sides of the at least one sensing pad have a first characteristic of the oscillator signal applied thereto at selected points in time and such that at least a second two outer array pads on the opposing sides of the at least one sensing pad have a second characteristic of the oscillator signal applied thereto at selected points in time.

7. The device of claim 5, wherein the predetermined pattern comprises a selective application of the oscillator signal to the at least two pairs of outer array pads in a sequence such that at least a first two adjacent pairs of outer array pads on the opposing sides of the at least one sensing pad have a first characteristic of the oscillator signal applied thereto at selected points in time and such that at least a second two adjacent outer array pads on the opposing sides of the at least one sensing pad have a second characteristic of the oscillator signal applied thereto at selected points in time.

8. The device of claim 7, wherein the at least a first two adjacent pairs of outer array pads on the opposing sides of the at least one sensing pad having the first characteristic of the oscillator signal applied thereto at selected points in time are adjacent to the at least a second two adjacent outer array pads on the opposing sides of the at least one sensing pad having the second characteristic of the oscillator signal applied thereto at selected points in time.

9. The device of claim 1, wherein a width dimension of each one of the at least two pairs of outer array pads is greater than the width of the security thread, and wherein the at least one outer array pad has a dimension that is angled with respect to a dimension of the thread.

* * * * *